US011724535B2

(12) United States Patent
Schiller et al.

(10) Patent No.: US 11,724,535 B2
(45) Date of Patent: Aug. 15, 2023

(54) PEN

(71) Applicant: SCHWAN-STABILO COSMETICS GMBH & CO. KG, Heroldsberg (DE)

(72) Inventors: Dieter Schiller, Rückersdorf (DE); Clemens Wiesmann, Heroldsberg (DE); Tobias Kötter, Forchheim (DE)

( * ) Notice: Subject to any disclaimer, the term of this patent is extended or adjusted under 35 U.S.C. 154(b) by 0 days.

(21) Appl. No.: 17/764,172

(22) PCT Filed: Sep. 15, 2020

(86) PCT No.: PCT/EP2020/075739

§ 371 (c)(1),
(2) Date: Mar. 26, 2022

(87) PCT Pub. No.: WO2021/073822

PCT Pub. Date: Apr. 22, 2021

(65) Prior Publication Data

US 2022/0339960 A1 Oct. 27, 2022

(30) Foreign Application Priority Data

Oct. 15, 2019 (DE) ..... 20 2019 004 256.3

(51) Int. Cl.
*B43K 15/00* (2006.01)
*B43K 5/00* (2006.01)
(Continued)

(52) U.S. Cl.
CPC ..... *B43K 15/00* (2013.01); *A45D 40/20* (2013.01); *B43K 5/005* (2013.01); *B43K 7/005* (2013.01); *B43K 8/003* (2013.01); *B43K 23/12* (2013.01)

(58) Field of Classification Search
CPC ..... B43K 15/00; B43K 5/005; B43K 7/005; B43K 8/003; B43K 23/12; A45D 40/20
(Continued)

(56) References Cited

U.S. PATENT DOCUMENTS 2,518,128 A 4/1950 Dufilho
3,115,118 A 12/1963 Anderson et al.
(Continued)

FOREIGN PATENT DOCUMENTS

DE 1267144 4/1968
DE 1267144 B 4/1968
(Continued)

OTHER PUBLICATIONS

European Patent Office, International Search Report for International Application No. PCT/EP2020/075739, dated Nov. 24, 2020.
(Continued)

*Primary Examiner* — David J Walczak
(74) *Attorney, Agent, or Firm* — Bradley Arant Boult Cummings LLP; Timothy L. Capria; Alexandra C. Lynn

(57) ABSTRACT

A pen for cosmetic, writing, drawing, sketching and/or marking purposes includes an inner part and an outer part, wherein at least a portion of the inner part is accommodated in the outer part and is fastened therein. A fastening device between the inner part and the outer part serves to fasten the inner part to the outer part, wherein the fastening device is elastically deformable and is deformed in the installed state against its elastic restoring force. The fastening device is supported between the inner part and the outer part by the elastic restoring force to fasten the inner part to the outer part.

19 Claims, 3 Drawing Sheets

Figure 1A:
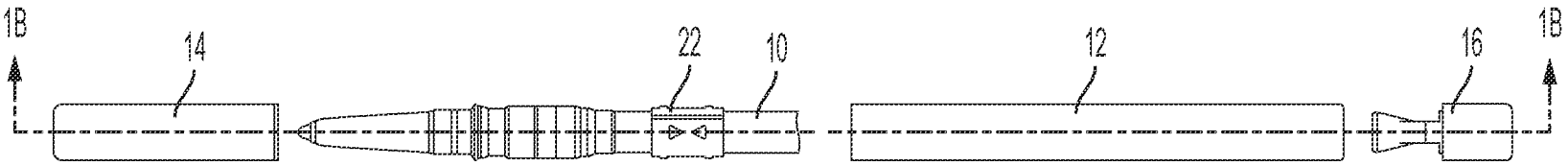

(51) Int. Cl.

| | |
|---|---|
| ***B43K 7/00*** | (2006.01) |
| ***B43K 8/00*** | (2006.01) |
| ***B43K 23/12*** | (2006.01) |
| ***A45D 40/20*** | (2006.01) |

(58) Field of Classification Search
USPC ..... 401/207, 222, 251, 257
See application file for complete search history.

(56) References Cited

U.S. PATENT DOCUMENTS

| | | | | |
|---|---|---|---|---|
| 3,765,782 | A * | 10/1973 | Defores | B43K 15/00 401/251 |
| 3,768,845 | A | 10/1973 | Gilliland | |
| 5,294,205 | A | 3/1994 | Moeck et al. | |
| 5,836,708 | A | 11/1998 | Tani | |
| 2015/0224813 | A1* | 8/2015 | Willemin | B43K 23/10 401/98 |

FOREIGN PATENT DOCUMENTS

| | | |
|---|---|---|
| DE | 69424282 T2 | 11/2000 |
| WO | 95/01071 | 1/1995 |

OTHER PUBLICATIONS

European Patent Office, Written Opinion of the International Searching Authority for International Application No. PCT/EP2020/075739, dated Nov. 24, 2020.

* cited by examiner

PEN

The invention relates to a pen for cosmetic, writing, drawing, sketching and/or marking purposes, having an inner part and an outer part, wherein the inner part is at least partially accommodated in the outer part and is fastened therein.

Pens of the type mentioned initially are known. In this case, an adhesive serves to fasten the inner part in the outer part. Through the use of the adhesive, additional material is introduced into the assembly, which is objectionable and error-prone both during processing and also from the point of view of the evaluation of material reliability. In addition, high costs are incurred for equipment, machines, production and processing processes, and personnel.

In addition, the requirements for materials for cosmetic purposes are very high, which is why only a few adhesives can be used in this respect.

Finally, relevant manufacturing processes can only be controlled during bonding with a high amount of effort, because environmental conditions, such as the temperature and the atmospheric humidity, strongly influence relevant methods.

The object of the invention is to develop the pen of the type mentioned at the outset in such a way that the material reliability is increased, the costs for equipment, machines, production processes and personnel are reduced, and cosmetically harmless materials can be used.

According to the invention, the object set out is achieved in that a fastening device between the inner part and the outer part serves to fasten the inner part to the outer part, which fastening device is elastically deformable and is deformed in the installed state against its elastic restoring force, wherein it is supported between the inner part and the outer part by means of the elastic restoring force to fasten the inner part to the outer part.

In other words, the invention uses an elastic component that utilizes its elasticity to fasten the inner part to the outer part, thereby dispensing with adhesive. The fastening device only has to be brought between the inner part and the outer part, which considerably simplifies the production process and thereby reduces the costs. In addition, it is very easy to find suitable materials for the fastening device which can be used harmlessly for cosmetic purposes in particular. Finally, the dependence on environmental conditions such as temperature and atmospheric humidity can be eliminated by the use of the fastening device.

According to a preferred embodiment of the invention, the fastening device has at least one anchoring element which bears against the inner part for anchoring purposes. The anchoring element can be a tooth or a mandrel.

For the same reason, it can be provided according to the invention that the fastening device has at least one anchoring element, which bears against the outer part for anchoring purposes. This in turn can be a tooth or a mandrel.

According to a particularly preferred embodiment of the invention, it is provided that the fastening device has at least one anchoring element, which counteracts a withdrawal of the inner part from the outer part more strongly than an insertion of the inner part into the outer part.

In other words, in spite of the presence of the fastening element, the inner part can be inserted into the outer part to produce the pen, whereas the inverse process requires significantly greater effort. Overall, this greatly simplifies the production method.

According to the invention, it can even be provided that the fastening device has at least one anchoring element, which blocks the inner part from being withdrawn from the outer part.

This embodiment of the invention achieves a permanent and no longer non-destructively releasable fastening of the inner part to the outer part.

According to the invention, the fastening device can be designed in such a way that the inner part can be withdrawn from the outer part only with difficulty or not at all, whereas a rotation is still possible. According to a further embodiment of the invention, however, it can also be provided that the fastening device has at least one anchoring element which blocks the inner part from rotating with respect to the outer part.

According to the invention, the anchoring element can be of any design. It is preferably formed integrally with the fastening device. The number of parts is thereby kept small.

According to the invention, the fastening device is furthermore preferably disk-shaped or sleeve-shaped. A particularly simple structure is thus created.

While the fastening device can be made of any material, provided that the elasticity provided according to the invention is ensured, it is preferably made of metal according to the invention.

Figure 1B:
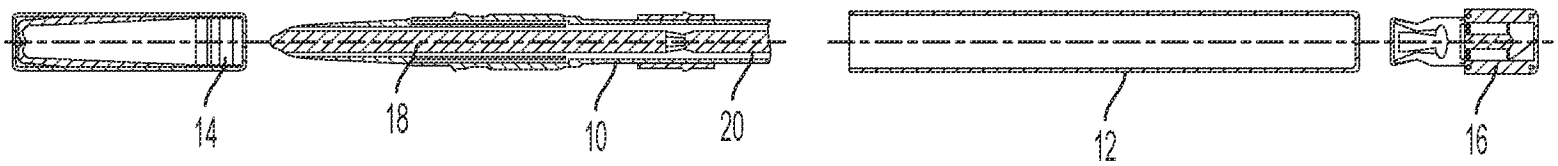
Figure 2A:
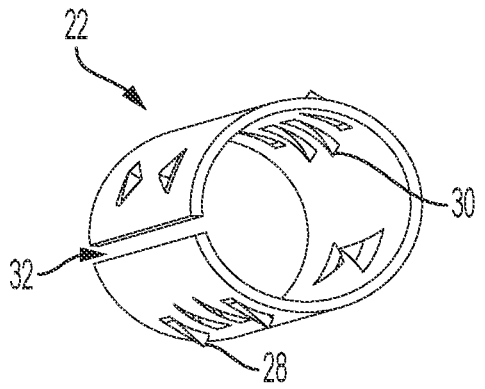
Figure 2B:
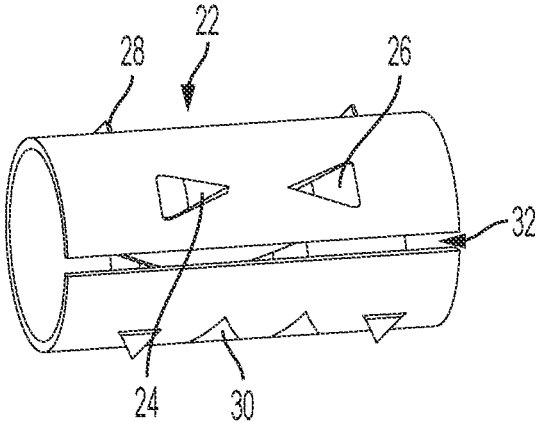
Figure 2C:
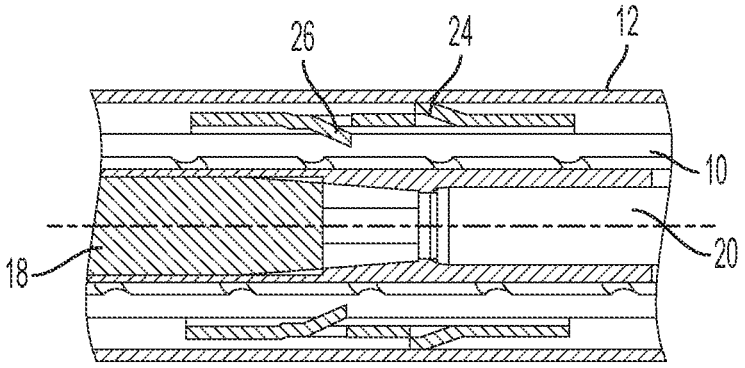
Figure 2D:
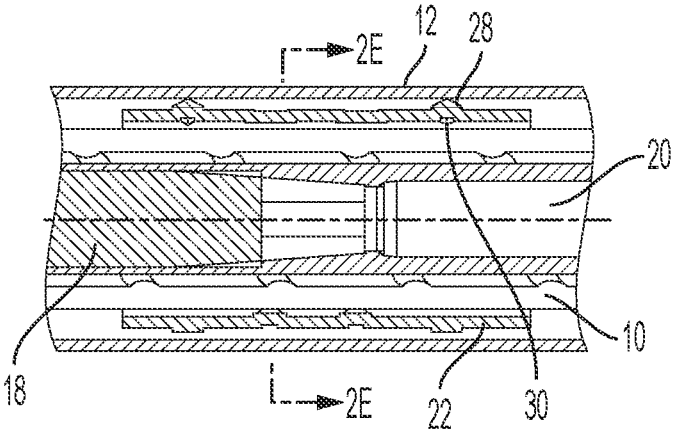
Figure 2E:
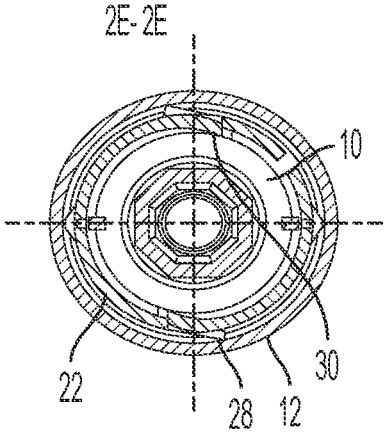
Figure 3A:
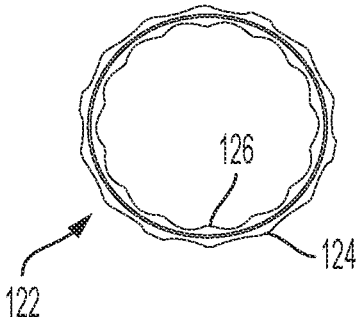
Figure 3B:
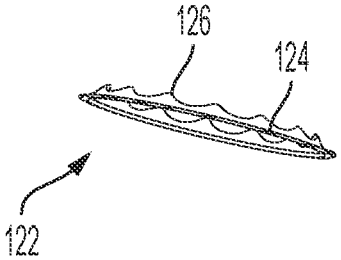
Figure 3C:
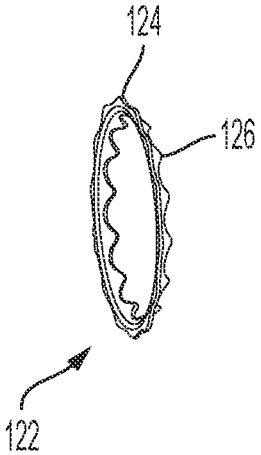
Figure 4:
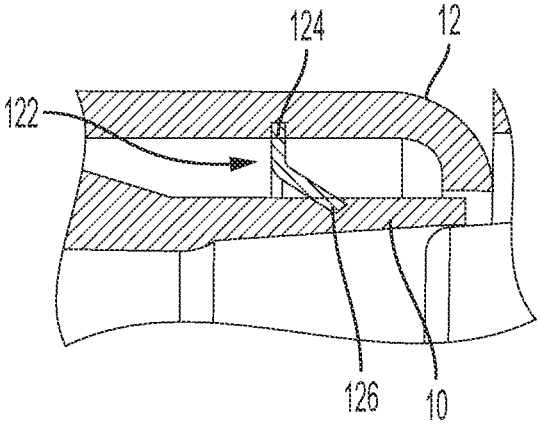

The invention is explained in more detail below with the aid of preferred exemplary embodiments with reference to the accompanying drawing. The following are shown:

FIG. 1A an exemplary embodiment of the pen according to the invention,

FIG. 1B a sectional view along line 1B-1B in FIG. 1A,

FIGS. 2A and 2B perspective views of a first exemplary embodiment of a fastening device of the pen according to the invention in perspective view, FIGS. 2C and 2D partial longitudinal sectional views of the fastening device according to FIGS. 2A and 2B, FIG. 2E a cross-sectional view of the fastening device according to FIG. 2D along line 2E-2E, FIG. 3A a plan view of another exemplary embodiment of the fastening device in the longitudinal direction of the pen, FIGS. 3B and 3C perspective views of the fastening device according to FIG. 3A, and FIG. 4 a schematic partial sectional view of the fastening device according to FIGS. 3A-C in the installed state.

In FIG. 1A, the pen shown in the drawing includes an inner part 10, an outer part 12, a protector 14 and a plug 16. In FIG. 1B, the inner part 10 houses a reservoir 18 and a cavity 20.

To assemble the pen, a fastening device 22 is attached to the inner part 10, whereupon the outer part 12 is slid onto the inner part 10 or the inner part 10 is inserted into the outer part 12. The inner part 10 may be fully or partially accommodated in the outer part 12. The plug 16 is plugged in and the protector 14 is placed on.

In the exemplary embodiment shown, the fastening device 22 is made of metal. However, it can also consist of another material or a combination of materials. It has anchoring elements 24, 26, 28 and 30. In this case, the specified reference sign 24, 26, 28 and 30 each represent, by way of example, a class of anchoring elements: the anchoring elements 24 anchor the fastening device 22 to the outer part 12 in the longitudinal direction. The anchoring elements 26 anchor the fastening device 22 to the inner part 10 in the longitudinal direction. The anchoring elements 28 anchor the fastening device 22 to the outer part 12 in the circumferential direction. The anchoring elements 30 anchor the fastening device 22 to the inner part 10 in the circumferential direction. That is, the anchoring elements 24 and 28 (also referred to as outer part anchoring elements) anchor the fastening device 22 to the outer part 12, and the anchoring elements 26 and 30 (also referred to as inner part anchoring elements) anchor the fastening device 22 to the inner part 10.

The anchoring functions as follows: If, after attaching the fastening device 22, the outer part 12 is slid onto the inner part 10 and thus onto the fastening device 22, the fastening device 22 is deformed against its elastic restoring force. This deformation occurs because an imaginary circle around the tips of the anchoring elements 24 and 28 is larger in the uninstalled state than the inner circumference of the outer part 12, and an imaginary circle around the tips of the anchoring elements 26 and 30 is smaller than the outer circumference of the inner part 10 in the attachment region of the fastening device 22. In this case, the elastic restoring force may be due to a deformation of the anchoring elements 24, 26, 28 and 30. However, it may also be due to a global deformation of the fastening device 22, which is possible in particular because the fastening device 22 has the form of a slotted sleeve. For example, as shown in FIGS. 2A and 2B, the fastening device 22 may have an open slot 32 that runs along the length of the device 22. Given the slot 32, the sleeve-shaped fastening device 22 can namely be bent and compressed against an elastic restoring force.

The specified restoring force is the force with which the anchoring elements 24, 26, 28, 30 are supported on the inner part 10 or the outer part 12, for which reason the resulting frictional force already holds the inner part 10 in the outer part 12. However, the anchoring elements 24, 26, 28, 30 are also tapered, for which reason they dig into the outer part 12 and the inner part 10. The anchoring elements 24 and 26 are also not arranged symmetrically, but rather, given their arrangement, hardly resist an insertion of the inner part 10 into the outer part 12, but nevertheless resist a withdrawal of the inner part 10 from the outer part 12. The anchoring elements 28 and 30 are also asymmetrical. In the illustrated form, they allow the inner part 10 to rotate against the outer part 12 in one direction, while blocking in the other direction. However, the locking elements 28 and 30 can also be designed in such a way that they prevent a rotation in both directions.

While the fastening device 22 according to FIGS. 1A-B and 2A-E is embodied in the form of a sleeve, the fastening device 122 according to FIGS. 3A-C and 4 has the form of a disk, in particular a toothed disk, because the anchoring elements there are designed in the form of teeth. Two of the anchoring elements are denoted by reference sign 124 and 126, respectively, wherein the anchoring element 124 serves to anchor to the outer part 12 and the anchoring element 126 serves to anchor to the inner part 10. Once again, an imaginary outer circle around the tips of the anchoring elements 124 is larger than the inner diameter of the outer part 12, and an imaginary circle along the inner tips of the anchoring elements 126 is smaller than the outer diameter of the inner part 10. This results in an elastic restoring force during assembly, which leads to the anchoring elements 124 and 126 digging into the outer part 12 and the inner part 10. This digging in is shown in FIG. 4 (somewhat exaggerated for the sake of clarity).

By digging into the outer part 12 and the inner part 10, the anchoring elements 124 and 126 block the inner part 10 not only from being withdrawn from the outer part 12 but also—at least to a certain extent—the inner part 10 from rotating against the outer part 12.

The features of the invention disclosed in the above description, claims, and drawing may, both individually and in any combination, be essential to the realization of the invention in its various embodiments.

What is claimed is:

1. A pen for cosmetic, writing, drawing, sketching and/or marking purposes, the pen comprising:

an inner part;

an outer part, wherein at least a portion of the inner part is accommodated in the outer part and fastened with the outer part; and an elastically deformable fastening device disposed between the inner part and the outer part, the elastically deformable fastening device having an elastic restoring force, wherein the elastically deformable fastening device includes an installed state when the elastically deformable fastening device is deformed against the elastic restoring force, and wherein the elastic restoring force supports the elastically deformable fastening device between the inner part and the outer part to fasten the inner part to the outer part.

2. The pen according to claim 1, wherein the elastically deformable fastening device comprises at least one inner part anchoring element bearing against the inner part for anchoring the elastically deformable fastening device with the inner part.

3. The pen according to claim 2, wherein in that the inner part anchoring element is formed integrally with the elastically deformable fastening device.

4. The pen according to claim 1, wherein the elastically deformable fastening device comprises at least one outer part anchoring element bearing against the outer part for anchoring the elastically deformable fastening device with the outer part.

5. The pen according to claim 4, characterized in that the outer part anchoring element is formed integrally with the elastically deformable fastening device.

6. The pen according to claim 1, wherein the elastically deformable fastening device comprises at least one anchoring element configured to counteract a withdrawal of the inner part from the outer part more strongly than an insertion of the inner part into the outer part.

7. The pen according to claim 1, wherein the elastically deformable fastening device comprises at least one anchoring element configured to block the inner part from being withdrawn from the outer part.

8. The pen according to claim 1, wherein the elastically deformable fastening device comprises at least one anchoring element configured to block the inner part from rotating with respect to the outer part.

9. The pen according to claim 1, wherein the elastically deformable fastening device is disk-shaped or sleeve-shaped.

10. The pen according to claim 9, wherein the elastically deformable fastening device is sleeve-shaped and comprises a sleeve slot.

11. The pen according to claim 10, wherein the sleeve slot anchors the first part with the second part.

12. The pen according to claim 9, wherein the elastically deformable fastening device is disk-shaped and comprises one or more disk teeth.

13. The pen according to claim 12, wherein the one or more disk teeth anchor the first part with the second part.

14. The pen according to claim 1, wherein the elastically deformable fastening device is made of metal.

15. The pen according to claim 1, wherein the elastically deformable fastening device is sleeve-shaped and comprises one or more anchoring elements disposed around the elastically deformable fastening device.

16. The pen according to claim 15, wherein the anchoring element fixes the rotation of the inner part relative to the outer part clockwise, counterclockwise, or both clockwise and counterclockwise.

17. The pen according to claim 1, wherein the inner part and the outer part are aligned along an axis.

18. The pen according to claim 1, further comprising a plug for plugging the outer part.

19. The pen according to claim 1, wherein at least a portion of the inner part is slidably receivable in the outer part.

* * * * *